US007464514B2

(12) United States Patent
Hänggli

(10) Patent No.: US 7,464,514 B2
(45) Date of Patent: Dec. 16, 2008

(54) CONNECTOR FOR TUBULAR MUNTIN BARS

(76) Inventor: Alfred Hänggli, Langstrasse 12, Niedergösgen (CH) CH-5013

( * ) Notice: Subject to any disclaimer, the term of this patent is extended or adjusted under 35 U.S.C. 154(b) by 0 days.

(21) Appl. No.: 11/676,893

(22) Filed: Feb. 20, 2007

(65) Prior Publication Data

US 2008/0196345 A1 Aug. 21, 2008

(51) Int. Cl.
*E04C 2/42* (2006.01)

(52) U.S. Cl. ..... 52/665; 52/204.61; 52/456; 24/297; 24/458

(58) Field of Classification Search ..... 52/204.61, 52/314, 456, 664, 665, 666, 667, 668, 655.1; 24/297, 457, 458; 403/326, 329; 49/50
See application file for complete search history.

(56) References Cited

U.S. PATENT DOCUMENTS 1,789,280 A * 1/1931 Armstrong ..... 403/346
3,293,817 A * 12/1966 MacGregor ..... 52/456
3,471,985 A * 10/1969 Lindelow ..... 52/204.591
3,678,651 A * 7/1972 Hicks ..... 52/204.61
3,686,814 A * 8/1972 Anderson ..... 52/456
3,748,814 A * 7/1973 Cribben ..... 52/668
3,927,950 A * 12/1975 Hermann et al. ..... 403/346
4,060,950 A * 12/1977 Rackard et al. ..... 52/456
4,437,284 A * 3/1984 Cribben et al. ..... 52/456
4,723,388 A * 2/1988 Zieg ..... 52/665
4,845,911 A * 7/1989 Winston et al. ..... 52/456
5,099,626 A * 3/1992 Seeger ..... 52/314
5,351,459 A * 10/1994 Kassl et al. ..... 52/656.5
5,456,048 A * 10/1995 White ..... 52/204.61
D380,054 S * 6/1997 Littlejohn ..... D25/61
5,791,102 A * 8/1998 Sheath et al. ..... 52/204.7
6,035,597 A * 3/2000 Donaldson ..... 52/456
6,192,651 B1 * 2/2001 Donaldson ..... 52/742.13
6,244,012 B1 * 6/2001 McGlinchy et al. ..... 52/665
6,301,843 B1 * 10/2001 Silverman ..... 52/204.5
6,425,221 B1 * 7/2002 Reichert ..... 52/456
6,494,002 B1 * 12/2002 Gieseke ..... 52/204.61
6,739,101 B2 * 5/2004 Trpkovski ..... 52/206
6,792,724 B2 * 9/2004 Burgess ..... 52/204.61
6,868,596 B2 * 3/2005 Reichert ..... 29/407.05
6,883,278 B2 * 4/2005 McGlinchy et al. ..... 52/204.61
6,898,914 B2 * 5/2005 Folsom et al. ..... 52/656.8
7,100,335 B2 * 9/2006 Plummer et al. ..... 52/204.61
D557,133 S * 12/2007 Magill et al. ..... D8/400
2002/0104273 A1 * 8/2002 Trpkovski ..... 52/172
2004/0037985 A1 * 2/2004 McGlinchy et al. ..... 428/36.9
2004/0083662 A1 * 5/2004 McGlinchy ..... 52/204.61
2004/0187407 A1 * 9/2004 Trpkovski ..... 52/204.5
2004/0216402 A1 * 11/2004 Folsom et al. ..... 52/204.53
2005/0023813 A1 * 2/2005 Biglino ..... 280/743.2
2005/0204664 A1 * 9/2005 Snyder ..... 52/302.1
2006/0185294 A1 * 8/2006 Langer et al. ..... 52/456

* cited by examiner

*Primary Examiner*—Robert Camfield
*Assistant Examiner*—Charissa Ahmad
(74) *Attorney, Agent, or Firm*—Morriss O'Bryant Compagni, P.C.

(57) ABSTRACT

The present invention discloses a connector for easily connecting tubular muntin bars. This connector can be slipped into an opening of one muntin bar so that both ends will be anchored in the interior of that muntin bar. Then, by moving in one direction, the lever can be slipped into the interior of another muntin bar, and, by moving in an opposite direction the protrusion can be slipped into the interior of the other muntin bar. With the connector such placed, slight pressure on the muntin bars will lock the lever, so that the connector firmly connects the muntin bars.

20 Claims, 3 Drawing Sheets

CONNECTOR FOR TUBULAR MUNTIN BARS

BACKGROUND OF THE INVENTION

To provide a double glazed window with the appearance of a traditional divided lite window having smaller panes separated by conventional muntin bars, it customary to provide intersecting tubular muntin bars between the panes of glass. These muntin bars are usually assembled in a cruciform design, one muntin bar intersecting another muntin bar at a right angle. This may be accomplished in different ways. U.S. Pat. No. 5,099,626 proposes a connector which on one end has hooks which engage openings in the planar side of a tubular muntin bar and at the other end has a plug which engages the hollow open end of a muntin bar. Accordingly, at each crossing two connectors are necessary. On the market is also another connector for connecting first and second tubular muntin bars which at their crossover have an opening. Each opening is of sufficient width to receive the other muntin bar. The connector for these bars has the form of a cross whose arms extend into the interior of the muntin bars to hold them together. Accordingly, only one connector is required for each crossing, but it is difficult to make a connection, because to insert the connector a muntin bar must be slightly bent. This may cause damage to the muntin bar.

SUMMARY OF THE PRESENT INVENTION

The present invention discloses a connector molded from flexible plastic material for connecting first and second hollow, tubular muntin bars at their crossover. These muntin bars have at their crossovers an opening of sufficient width to receive the other muntin bar. The connector has a body fitting into the interior of the first muntin bar. The body is of sufficient length to permit each end of the connector to extend into the said interior. From one side of the body extends a protrusion which fits into the interior of the second muntin bar. A lever is hinged to the body which on assemblying can slip with its free end into the interior of the second muntin bar. A snap device serves to lock the lever. When the lever is locked the connector holds the muntin bars together.

A primary object of the invention is to provide a connector for fast and easy connection of muntin bars without danger of damaging them on insertion of the connector.

Another object of the present invention is to require only one connector at the crossover of two muntin bars.

BRIEF DESCRIPTION OF THE DRAWINGS

In order that the invention may be more fully understood, it will now be described, by way of example, with reference with the accompanying drawings in which.

DETAILED DESCRIPTION OF AN EMBODIMENT

Figure 1:
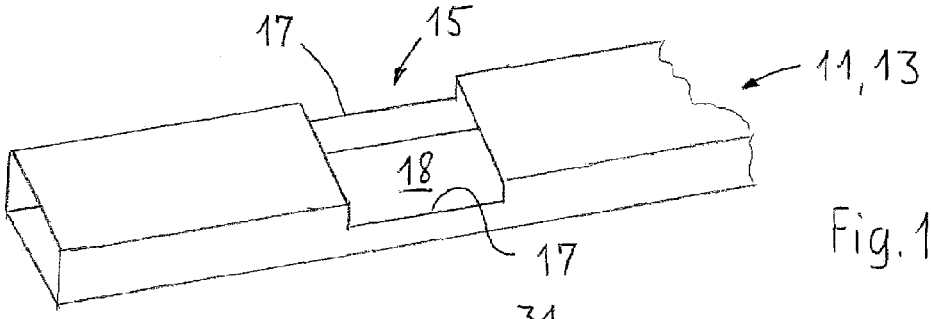
FIG. 1 is a perspective view of a muntin bar.

The following description describes in details an embodiment of the invention. This description should not be construed, however, as limiting the invention to this particular embodiment since the man skilled in the art will recognize numerous other embodiments. The tubular muntin bars 11, 13 shown in FIGS. 1 and 5 to 9 may be of prior art design. Such muntin bars have a rectangular cross section. However, also other cross sections, e.g. elliptical, would be possible. In the following description it is spoken of first and second muntin bars 11 and 13, but this is only made for description purposes. In fact, the first and second muntin bars have preferably the same profile, so that it does not matter into which muntin bar the connector is first inserted.

At the locations where the muntin bars 11, 13 will be crossing an opening 15 of sufficient width is provided in the muntin bar 11 to receive the other muntin bar 13 which is also provided with such an opening 15. Reference numerals 17 designate sidewalls at the opening 15, and reference number 18 designates the bottom of the profile.

Figure 2:
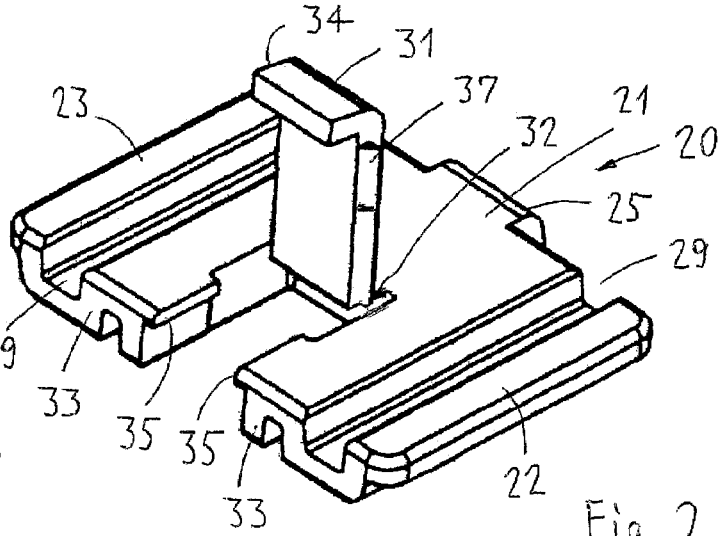
FIG. 2 is a perspective view of the connector ready for providing a connection of two muntin bars at their crossover.
Figure 3:
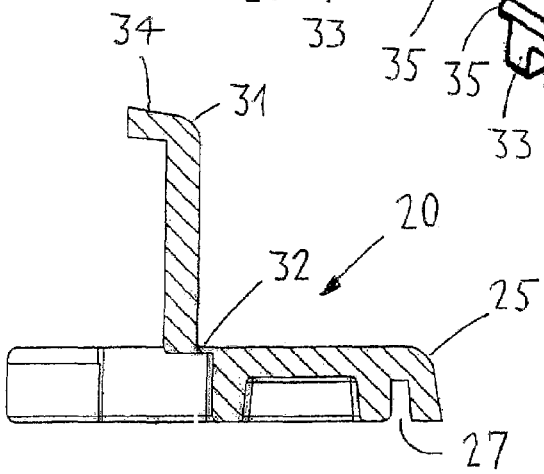
FIG. 3 is a cross section through the connector of FIG. 2.

Turning now to FIGS. 2 and 3 there is shown a connector 20 molded from flexible plastic material for connecting muntin bars 11, 13 as shown in FIGS. 5 to 9. The connector 20 has a body 21 with a cross section fitting snugly into the interior of a muntin bar 11 or 13. The length of the body 21 permits each end 22, 23 to extend from the opening 15 into the interior of the muntin bar 11. A protrusion 25 extends from one side of the body 21 and is dimensioned in height to fit snugly into the interior of a second muntin bar 13. A slot 27 (FIG. 3) is configured to receive the sidewall 17 of the muntin bar 11, but is not required if the cutout or opening 15 (FIG. 1) does not extend to the bottom 18 of the profile of the muntin bar 11. Similarly, recesses or slots 29 are provided to receive the sidewalls 17 of the muntin bar 13.

A lever 31 hinged by a film hinge 32 extends transversly from the center of the body 21. Prior to use of the connector 20 the lever 31 extends upward at an angle of about 30° to 90°, preferably about 45°. It is of such length that in locked condition (FIG. 4) its end 34 will protrude from the body 21 into the interior of the second muntin bar 13. A snap device 37, 35 (FIG. 2) serves to lock the lever 31 in the position of FIG. 4 when muntin bar 11, 13 are connected together, as will be described later on. The body 21 has to prongs 33 between which the lever 31 will be locked when it is moved into the shown position in FIG. 4. The snap device comprises a protrusion 35 extending laterally from each prong 33 for engaging with protrusions 37 (FIG. 2) extending laterally from the lever 31.

Figure 6:
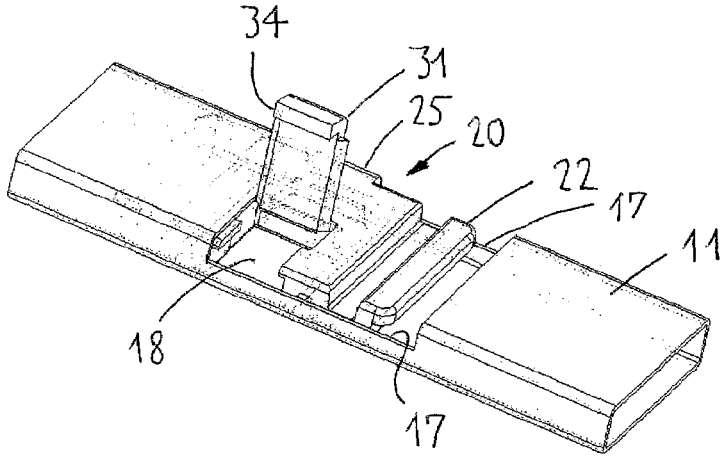
FIG. 6 shows the muntin bar of FIG. 5 with the connector inserted.
Figure 7:
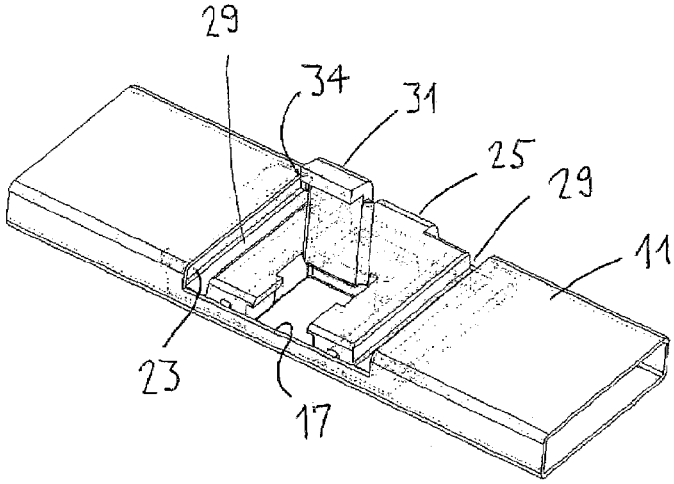
FIG. 7 is the muntin bar as shown in FIG. 6 but with the connector centered in the opening of the muntin bar.

In order to connect two muntin bars 11, 13 with a connector 20 the connector is first inserted with its end 23 into the interior of the muntin bar 11 (FIG. 5) until the other end 23 falls down to the bottom 18 of the opening 15 (FIG. 6). Then the connector 20 is moved in the muntin bar 11 somewhat back so that also the other end 23 moves into the interior of the muntin bar 11 (FIG. 7). Accordingly, if the connector 20 is centered in the opening 15, both ends 22, 23 will now be held by the muntin bar 11, and the slots 29 will be visible and ready to accommodate the sidewalls 17 of the other muntin bar 13.

Figure 4:
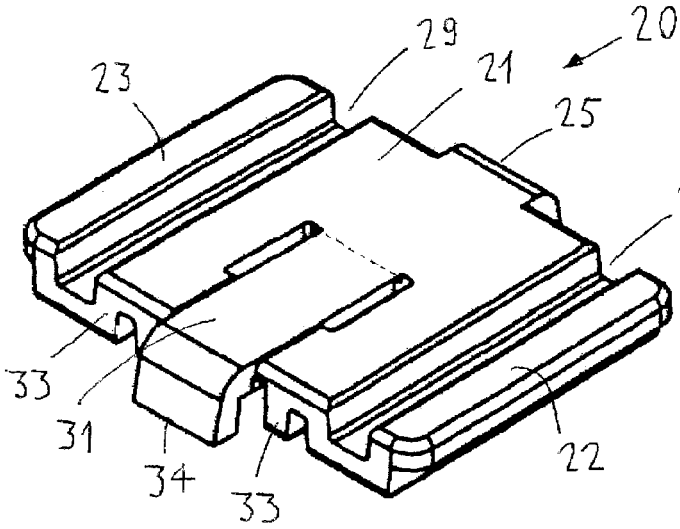
FIG. 4 is a perspective view of the connector according to FIG. 2 in the locked condition which provides the connection of two muntin bars at their crossover, but for clarity the muntin bars are not shown.
Figure 5:
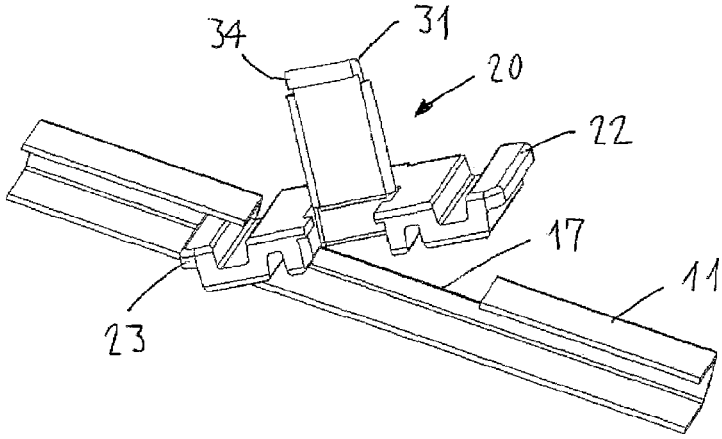
FIG. 5 is a perspective view illustrating the insertion of a connector into an opening in a first muntin bar which is shown in axial cross-section.
Figure 8:
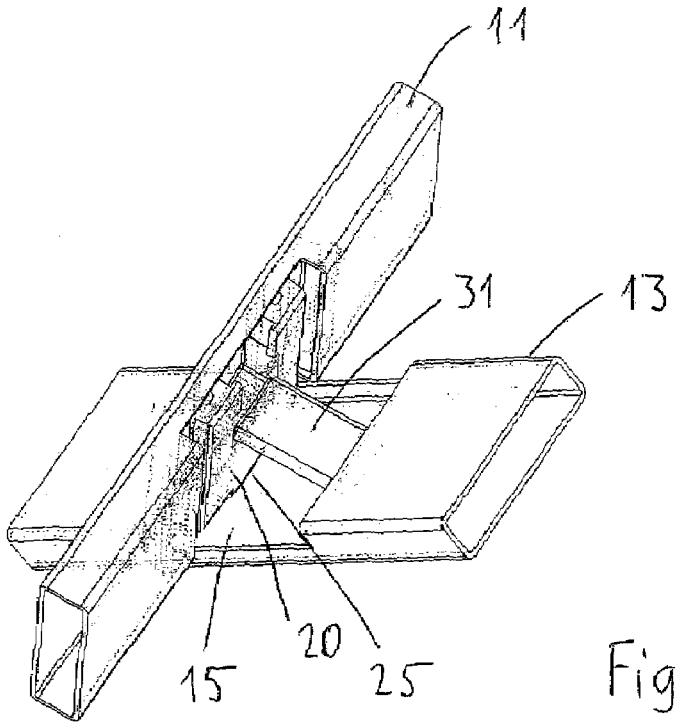
FIG. 8 shows the first muntin bar with the inserted connector being engaged to a second muntin bar.
Figure 9:
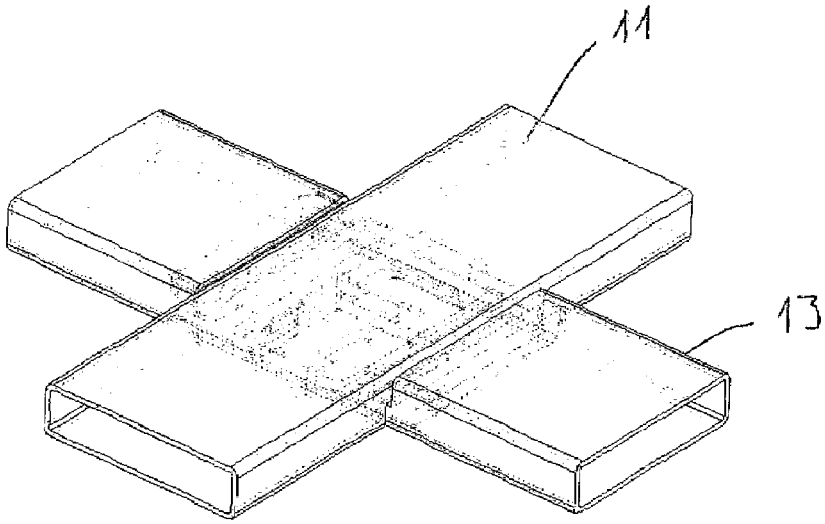
FIG. 9 shows the first muntin bar connected with the second muntin bar.

Now, as can be recognized from FIG. 8, the lever 31, by moving the muntin bar 11 relative to the muntin bar 13 in one direction, can be slipped into the interior of the second muntin bar 13, and then, by moving in opposite direction, the protrusion 25 can be slipped into the interior of the muntin bar 13. Accordingly, both the end 34 of the lever 31 and the protrusion 25 are now caught by the muntin bar 13. A slight pressure will then cause the snap device 35, 37 to lock the lever 31 as shown in FIG. 4, thereby firmly connecting the two muntin bars 11, 13 together (FIG. 9).

The result is an assembly of two tubular muntin bars 11, 13 with an opening 15 at their crossover being connected by a connector 20, of which the ends 22, 23 are anchored in the interior of the muntin bar 11, and the protrusion 25 and the lever 31, which is locked by a snap device 35, 37, are anchored in the interior of the muntin bar 13. Of course, a plurality of muntin bars 11 may be connected by a plurality of connectors 20 to a plurality of muntin bars 13, as will be evident to the man skilled in the art.

What is claimed is:

1. A connector molded from flexible plastic material for connecting a pair of crossing muntin bars, comprising:

first and second hollow, tubular muntin bars, said first and second muntin bars defining a crossover and each having at the crossover an opening of sufficient width to receive a portion of the other muntin bar, and a connector comprising:

interior of the first muntin bar;

a protrusion extending from one side of said body and fitting into the interior of the second muntin bar;

a lever being hinged on said body, said lever being capable of entering with its free end into the interior of the second muntin bar;

a snap device to lock said lever to said body on mounting the second muntin bar on the first muntin bar; and said body having two prongs to receive and, after mounting the second muntin bar on the first muntin bar, lock said lever in between said prongs.

2. The connector of claim 1 wherein the protrusion extending from one side of said body and the free end of said lever are dimensioned in height to fit into the interior of the second muntin bar.

3. The connector of claim 1 wherein said body has a recess near each of its ends for accommodating a side wall of the second muntin bar.

4. The connector of claim 3 wherein said lever has a film hinge and extends from the body transversely and prior to use of the connector upward at an angle.

5. The connector of claim 4 wherein the angle is in the range of 30° to 90°.

6. The connector of claim 1 wherein said body has two prongs to receive and, after mounting the second muntin bar on the first muntin bar, lock said lever in between said prongs.

7. The connector of claim 5 wherein said body has two prongs to receive and, after mounting the second muntin bar on the first muntin bar, lock said lever in between said prongs.

8. The connector of claim 6 wherein the snap device comprises protrusions extending laterally from said prongs for engaging with protrusions extending laterally from said lever.

9. The connector of claim 7 wherein the snap device comprises protrusions extending laterally from said prongs for engaging with protrusions extending laterally from said lever.

10. An assembly for connecting at least two muntin bars, comprising:

at least one first and at least one second muntin bar, each of said at least one first and at least one second muntin bar provided with an opening at a location of crossover of the at least one first and at least one second muntin bar for receiving at least a portion of the other muntin bar; and at least one connector comprising:

a body having a cross section corresponding to the interior cross section of the at least one first muntin bar and extending from both sides of the opening of the at least one first muntin bar into an interior of the at least one first muntin bar, a protrusion extending from one side of said body fitting into an interior of the at least one second muntin bar, a hinged lever extending with its free end on another side of said body into the interior of the second muntin bar, and a snap device to keep said hinged lever in locked condition with said body.

11. The assembly of claim 10, wherein the protrusion extending from one side of said body and the free end of said hinged lever are dimensioned in height to fit into the interior of the second muntin bar.

12. The assembly of claim 10, wherein said body has a recess near each of its ends for accommodating a side wall of the second muntin bar.

13. The assembly of claim 12, wherein said lever has a film hinge and extends from the body transversely and prior to use of the connector upward at an angle.

14. The assembly of claim 13, wherein the angle is in the range of 30° to 90°.

15. The assembly of claim 10, wherein said body has two prongs to receive and, after mounting the second muntin bar on the first muntin bar, lock said lever in between said prongs.

16. The assembly of claim 10, wherein the snap device comprises protrusions extending laterally from said prongs for engaging with protrusions extending laterally from said hinged lever.

17. The connector of claim 5, wherein the angle is about 45°.

18. A connector molded from flexible plastic material for connecting a first and a second hollow, tubular muntin bar at their crossover, each of said muntin bars having at the crossover an opening of sufficient width to receive the other muntin bar, comprising:

a body having a cross section fitting into the interior of the first muntin bar and a length to permit each end of the connector to extend from the opening into the interior of the first muntin bar, said body having two prongs to receive and, after mounting the second muntin bar on the first muntin bar, lock said lever in between said prongs;

a protrusion extending from one side of said body and fitting into the interior of the second muntin bar;

a lever being hinged on said body, said lever being capable of entering with its free end into the interior of the second muntin bar; and a snap device to lock said lever to said body on mounting the second muntin bar on the first muntin bar.

19. The connector of claim 18, wherein the protrusion extending from one side of said body and the free end of said lever are dimensioned in height to fit into the interior of the second muntin bar.

20. The connector of claim 18, wherein the snap device comprises protrusions extending laterally from said prongs for engaging with protrusions extending laterally from said lever.

* * * * *